US006066927A

United States Patent [19]

Koudijs

[11] Patent Number: 6,066,927

[45] Date of Patent: May 23, 2000

[54] PARTICLE ACCELERATOR ACCELERATING TUBE

[75] Inventor: Reijer Koudijs, CG Kootwijkerbroek, Netherlands

[73] Assignee: High Voltage Engineering Europa B.V., Amersfoot, Netherlands

[21] Appl. No.: 08/934,354

[22] Filed: Sep. 19, 1997

[30] Foreign Application Priority Data

Sep. 19, 1996 [EP] European Pat. Off. ..... 96202614

[51] Int. Cl.[7] ..... H05H 5/02

[52] U.S. Cl. ..... 315/506; 313/360.1

[58] Field of Search ..... 315/506; 313/360.1; 363/59; 338/64, 315, 293

[56] References Cited

U.S. PATENT DOCUMENTS

| | | | |
|---|---|---|---|
| 3,328,618 | 6/1967 | Wilson | 313/360.1 |
| 3,609,218 | 9/1971 | Herb | 315/506 |
| 3,793,550 | 2/1974 | Thompson | 313/63 |
| 3,903,424 | 9/1975 | Rose | 313/360.1 |
| 4,032,810 | 3/1978 | Eastham et al. | 313/360 |
| 4,862,135 | 8/1989 | Broadhurst | 338/64 |
| 4,879,518 | 11/1989 | Broadhurst | 313/360.1 |
| 5,034,718 | 7/1991 | Weisser et al. | 338/64 |
| 5,568,021 | 10/1996 | Bederka et al. | 315/506 |

FOREIGN PATENT DOCUMENTS

| | | | |
|---|---|---|---|
| 62-229796 | 10/1987 | Japan | H05N 5/00 |

OTHER PUBLICATIONS

"A Novel Accerelator Tube with Active Protection", J.H. Broadhurst, Seventh Tandem Conference, Berlin, West Germany, Apr. 6–10, 1987, Nuclear Instruments & Methods in Physics Research, Section A, May 30, 1988, pp. 368–375.

*Primary Examiner*—Michael H. Day
*Attorney, Agent, or Firm*—Jones, Day, Reavis & Pogue

[57] ABSTRACT

A particle accelerator includes one or more accelerating tubes (1) which accelerating tube (1) includes spatially separated electrodes (2), each electrode (2) surrounded by a corona ring (4). The electrode (2) includes at least one spark gap (6) having a connection for connecting one side of a resistor (7).

3 Claims, 7 Drawing Sheets

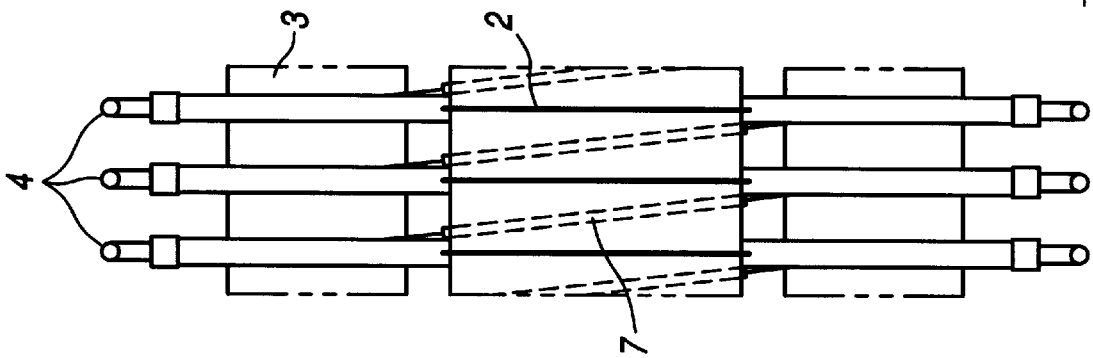
FIG. 4
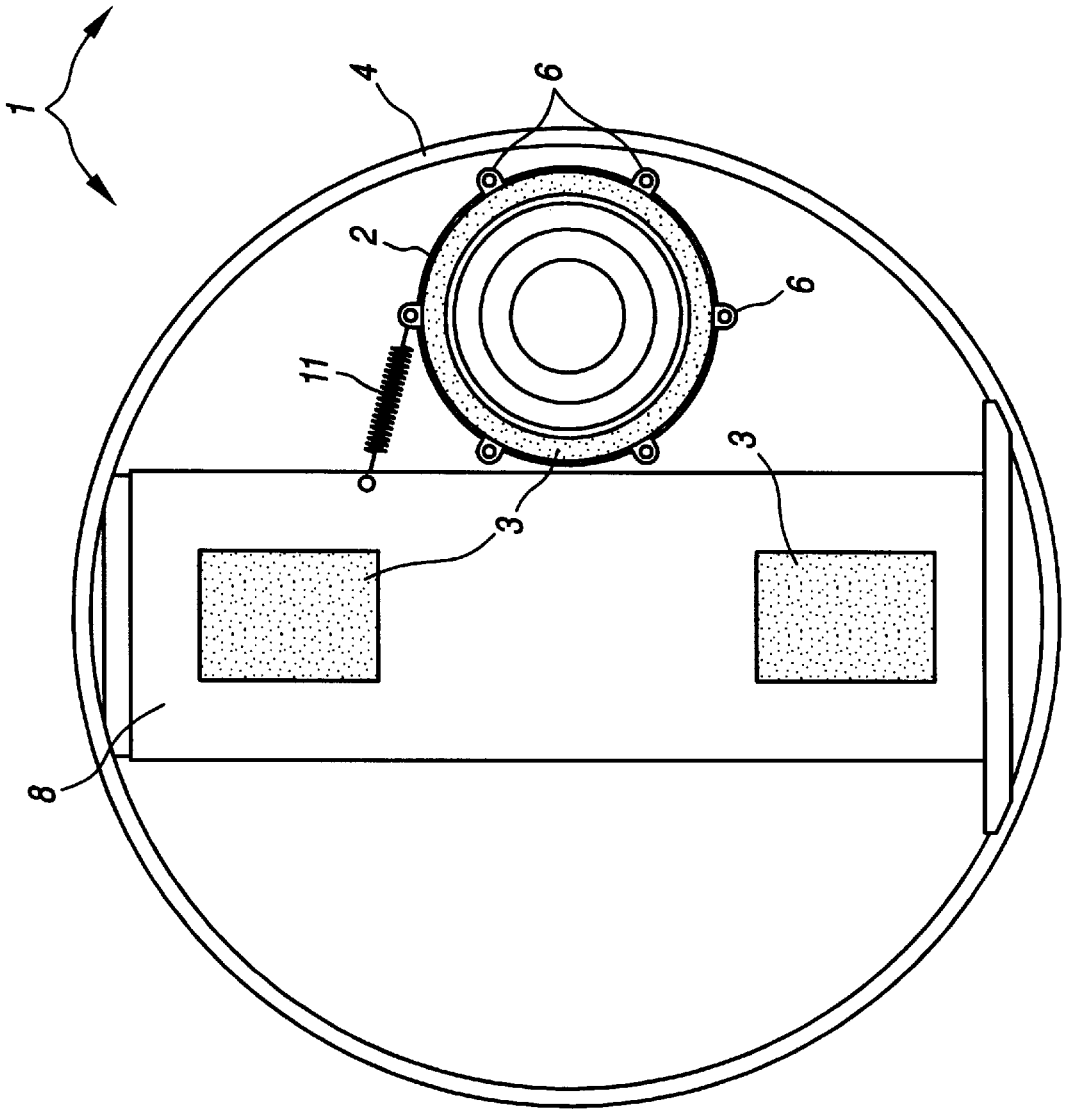

PARTICLE ACCELERATOR ACCELERATING TUBE

BACKGROUND OF THE INVENTION

The present invention relates to a particle accelerator having at least one accelerating tube comprising spatially separated electrodes, where each electrode is integrally formed with a corona ring or each electrode and a corresponding corona ring are formed prior to assembly.

Such particle accelerators, accelerating tubes and the method for manufacturing same are generally known. The known particle accelerators include an accelerating tube, in which electrodes which are spatially and electrically separated from each other both by means of successive insulators are arranged in substantially equally spaced-apart relationship. The electrodes are maintained at predetermined potentials, whereby the respective potential jumps between two adjacent electrodes are usually substantially the same. Each metal electrode of the accelerating tube is connected to a resistance voltage divider, as a result of which the potential of said electrode is maintained. Charged particles are accelerated in the accelerating tube by means of the electric field in the accelerating tube, in which a vacuum is usually maintained. In order to increase the breakdown strength in the accelerating tube a corona ring is mounted around nearly every electrode. Furthermore spark gaps are present, usually between adjacent electrodes, which function to protect the insulators and resistors against excessive voltages. The accelerated particles are for example used for scientific, industrial or educative purposes.

The assembly of such a known particle accelerator and the accelerating tube or accelerating tubes used therein takes place in such a manner that the respective corona rings are arranged in precisely spaced-apart relationship, at precisely determined positions with respect to the electrodes, by means of several spacers, which are usually adjustable for distance, and bolts and nuts, which are mounted and adjusted between each electrode and its associated corona ring.

The drawback of such a known particle accelerator, accelerating tube and the associated method for manufacturing same is that it includes a great many separate parts which must necessarily be precisely positioned relative to each other and be mounted by skilled personnel, who need to be specially trained.

SUMMARY OF THE INVENTION

The object of the present invention is to provide a particle accelerator, or accelerating tube for use in the particle accelerator, which includes fewer parts and whose assembly requires fewer manipulations by personnel who do not require special qualifications and special training, and thereby causing a considerable cost reduction as well as a reduction of assembly time.

The particle accelerator according to the invention has at least one accelerating tube built up of elements, where each element includes an integral electrode and corona ring.

The accelerating tube according to the invention has a plurality of elements including pre-connected electrodes and respective corona rings.

The advantage of the present invention is the fact that the number of components to be assembled on site is limited, whilst the accuracy with which the positioning of each electrode and its associated corona ring takes place is retained. This also leads to a reduction of the time required for assembling a particle accelerator and an accelerating tube, whilst also the number of connections to be made on site is reduced, as a result of which assembly can take place more simply and more quickly. Moreover, no additional supporting structures are required for positioning the electrode and the corona ring with respect to each other and interconnecting them, because said electrode and said corona ring have already been fixedly interconnected in advance before being transported to the assembly site, where a quicker assembly with the other components can take place.

It is advantageous to provide the electrode of the thus prefabricated element with at least one spark gap already, prior to the assembly of the particle accelerator. This may for example take place by pressing or deep-drawing of the material of which the element is made. In this manner it is prevented that a spark gap must be formed on site.

The present invention will be explained in more detail hereafter with reference to the appended drawing. In the drawing like numbers indicate like parts of the accelerating tube.

BRIEF DESCRIPTION OF THE DRAWINGS

FIGS. 1–5 show longitudinal and sectional views of parts of one embodiment of an accelerating tube forming part of a known particle accelerator, in connection with which the present invention may be used;

DESCRIPTION OF THE PREFERRED EMBODIMENT

Figure 1:
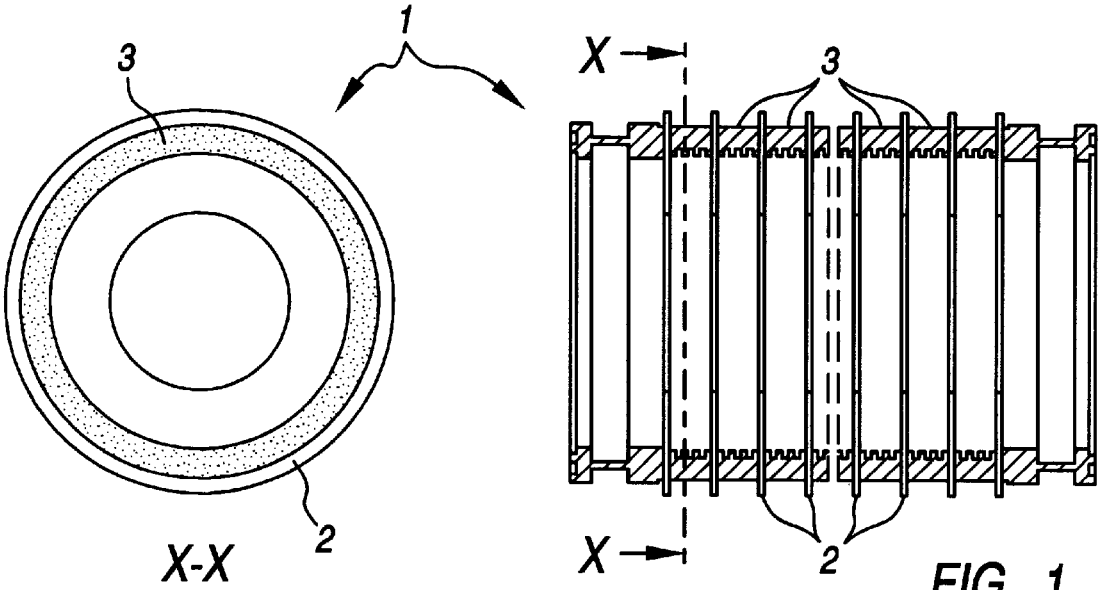
Figure 2:
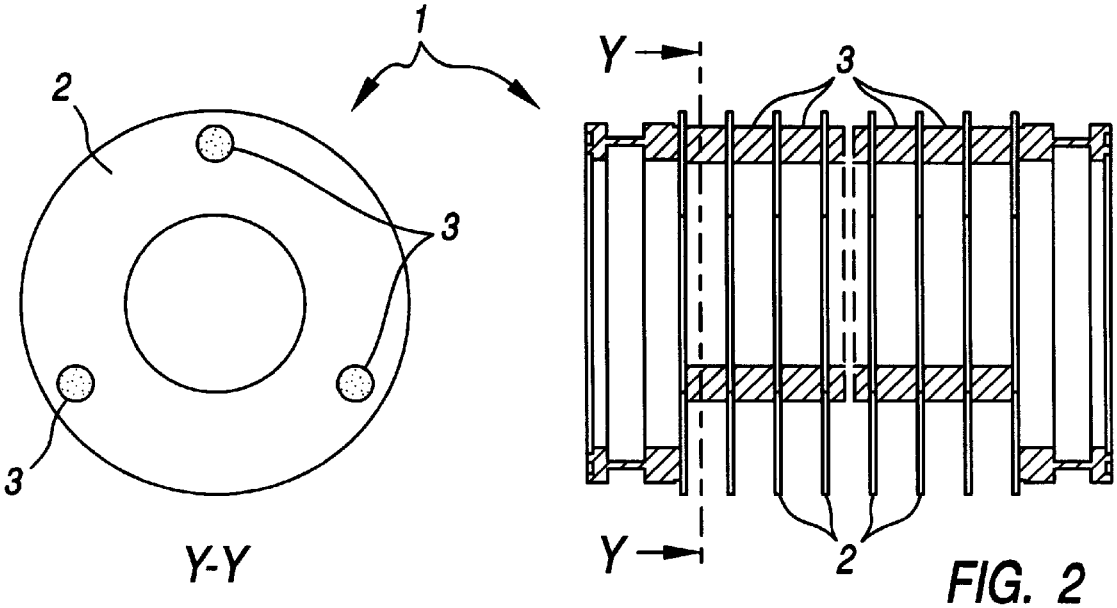

FIG. 1 shows in cross-section and in longitudinal section an accelerating tube 1, in which a series of parallel and at least substantially equally spaced-apart metal electrodes 2 are provided, which are separated from each other by means of insulators 3. The insulators 3 are annular in FIG. 1, whilst said insulators 3 form spacers between the electrodes 2 in the embodiment of FIG. 2. Upon assembly of the embodiment shown in FIGS. 1 and 2 the successive components, that is insulator 3, electrode 2, insulator 3, electrode 2, etc., can be placed one on top of the other and be fixedly interconnected in a manner which is known per se. It is advantageous to form an assembly of this type in such a manner that, as being proposed, elements are used prior to the eventual assembly of accelerating tube 1. In that case the successive elements, between which the insulators 3 are positioned, can be stacked together upon assembly, which can take place more quickly and accurately, because electrode 2 and an associated corona ring 4, which surrounds electrode 2, have already been fixed with respect to each other. The insulating material will contain glass, porcelain or a suitable ceramic material, for example, which is not the same material as the material of electrode 2, which usually contains aluminum, titanium or stainless steel. Insulators 3 and electrodes 2 are usually glued, soldered and/or pressed together.

Figure 3:
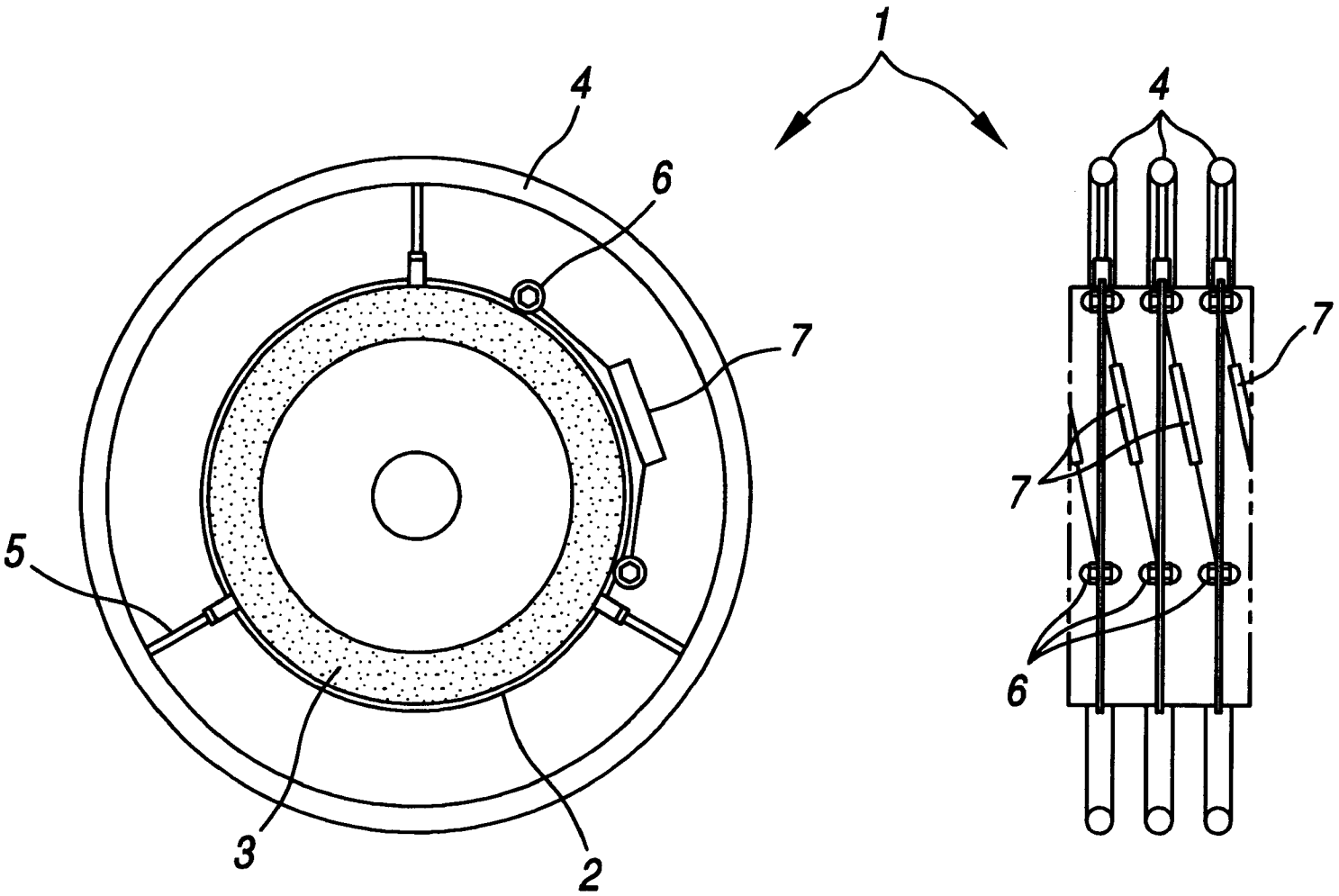
Figure 5:
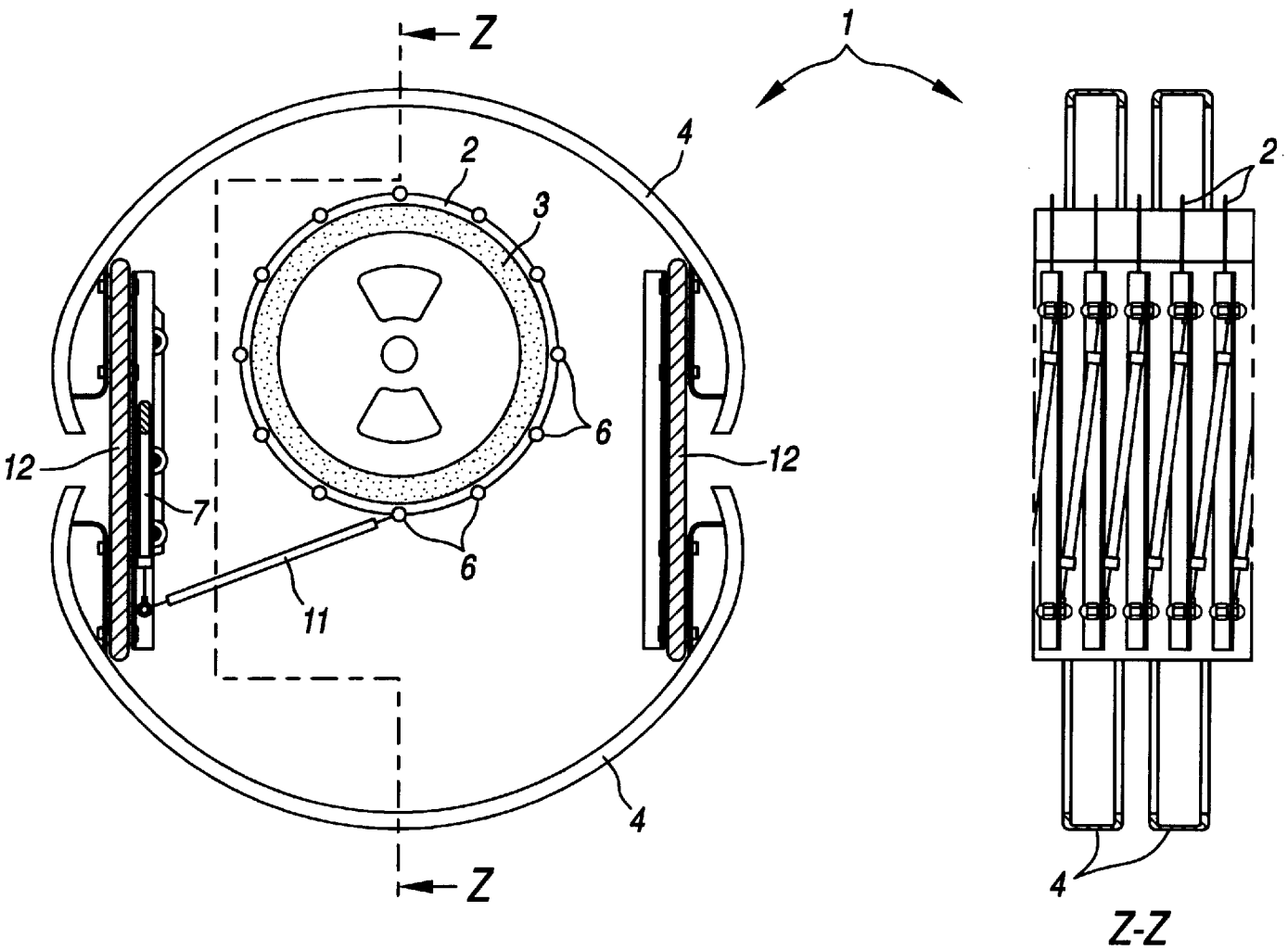

FIGS. 3–5 are cross-sectional and a longitudinal views of successive embodiments of accelerating tube 1. Positioned round the electrode 2 is corona ring 4, which is supported on accelerating tube 1 by means of corona ring mounting supports 5. The supports 5 include adjusting means for accurately positioning the corona ring 4 with respect to the accelerating tube 1. It is advantageous to use the same material for the electrode 2 and the corona ring 4; it is especially preferred to form one-piece elements, where the electrode and the corona ring associated therewith are made as one unit from one plate of material, usually in one operation or in a series of operations. After such an element has been formed, the eventual assembly of accelerating tube 1 may take place by stacking said elements alternately, whereby the bond between the elements and the insulators 3 is effected by gluing, soldering or pressing. In the embodiment of FIG. 3 an electrode 2 includes one or more spark gaps 6. The spark gaps 6 may include connections for a ladder network of resistors 7. The connecting of a resistor 7 may preferably take place by means of a screwed connection, a clamped connection or a clip-on connection. A clamped connection 20 is shown in FIG. 9*a* while a clip-on connection 22 is shown in FIG. 9*b*. It is preferred to form the spark gap 6 integrally with the element, and it is in particular preferred to form the element from one plate of material. In the embodiment of FIG. 3 the electrode and the corona ring are located concentrically with respect to each other and with respect to the accelerating tube 1.

FIG. 4 shows an embodiment where the centers of the accelerating tube 1 and the corona ring 4 are shifted with respect to each other. In this embodiment an equipotential section 8 is located within the corona ring 4 in an equipotential surface, in which also the electrode 2 and the corona ring 4 are placed. In this case a resistor 7 is mounted between adjacent equipotential sections 8. A conductor 11, which will usually consist of a spring or a connecting wire is located between the equipotential section 8 and the electrode 2. It is advantageous to form elements, of which also equipotential section 8 forms part, prior to assembly. Eventually elements can be formed together upon assembly, where each element consists of an electrode 2, a corona ring 4 and a mounting support 5 forming an integral part of the two parts, whilst the insulator 3 and the equipotential section 8 may already form part of the element. Furthermore the spark gaps 6 will already have been formed at the desired places in electrode 2.

FIG. 5 shows yet another embodiment of accelerating tube 1, where a corona ring 4 is made in two parts, which parts are held together by insulating plates 12 which are pre-mounted therein, which plates are mounted along the accelerating tube. Because the corona ring is made of two parts, the configuration of element, which includes at least an electrode 2 and a corona ring 4, which are preferably formed in one piece from a plate, will be slightly different, although the accelerating tube will be built up of elements.

Figure 6:
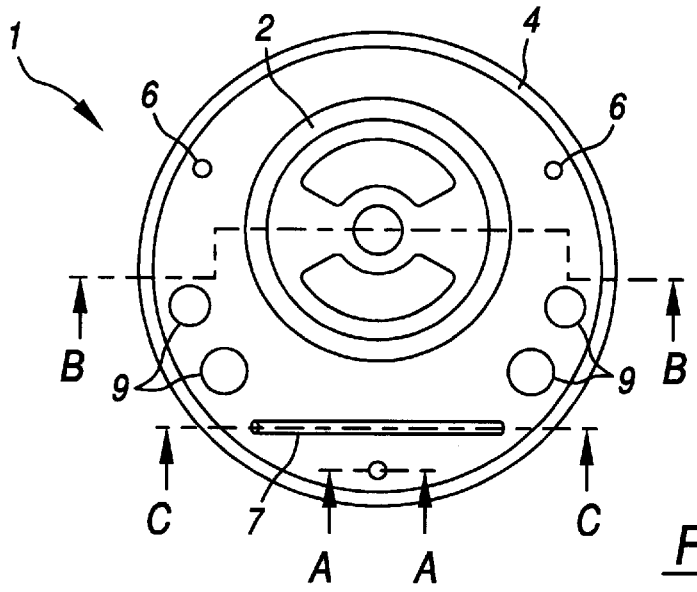
FIG. 6 shows another embodiment of the accelerating tube according to the invention.
Figure 7:
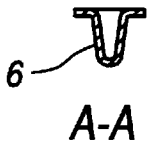
FIGS. 7–9 show details of a possible spark gap, of a possible configuration of the electrode, and of a possible connection of a resistor to successive electrodes.

FIG. 6 shows a possible embodiment wherein passages have been formed in the material between a corona ring 4 and an electrode 2, substantially in the longitudinal direction of accelerating tube 1. An insulated gas pipe may pass through the passages, for example, or it may function as a mechanical lead-through. The shape of the corona rings 4 may vary, depending on the use of the particle accelerator and the manner in which the element is machined, formed or pressed. The passages 9 may be cut out or blanked out, whilst the spark gaps 6, one possible embodiment of which is shown in detail in FIG. 7, may for example be formed by pressing, as is shown in this Figure.

Figure 8:
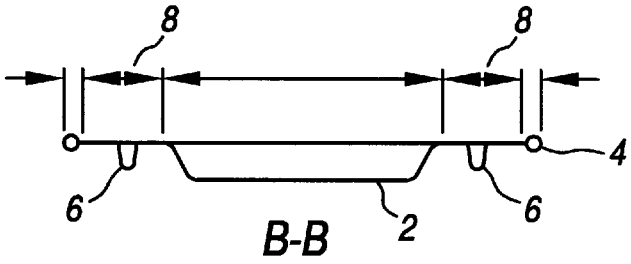

FIG. 8 shows an embodiment of the a pre-formed electrode-corona element, in which a spark gap 6 is also preformed. The element is curved and substantially dish-shaped.

Figure 9:
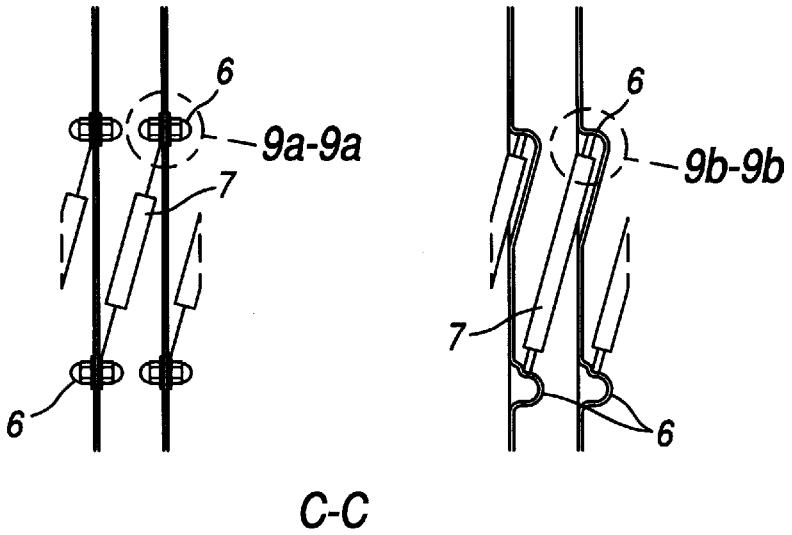
Figure 9A:
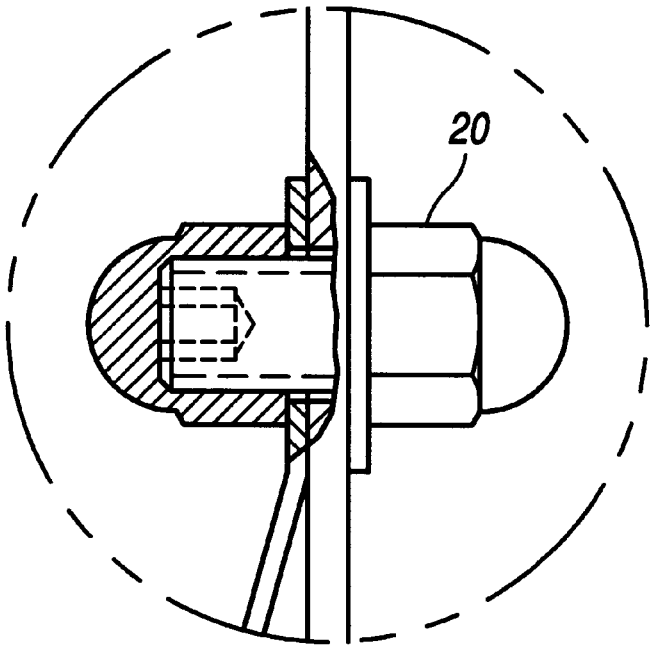
FIGS. 9*a* and 9*b* are enlargements of the circled portions of FIG. 9 which are marked 9*a*—9*a* and 9*b*—9*b*, respectively.
Figure 9B:
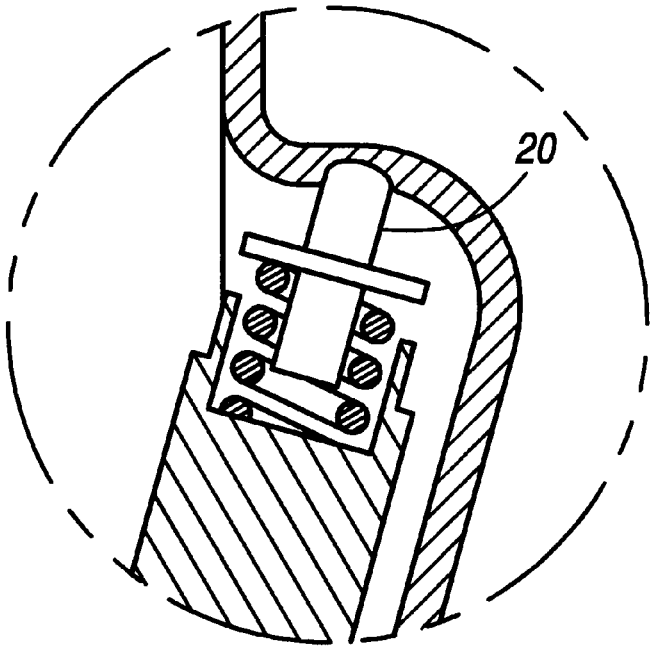

FIG. 9 shows in detail the manner in which resistors 7 can be connected between various spark gaps 6.

Figure 10:
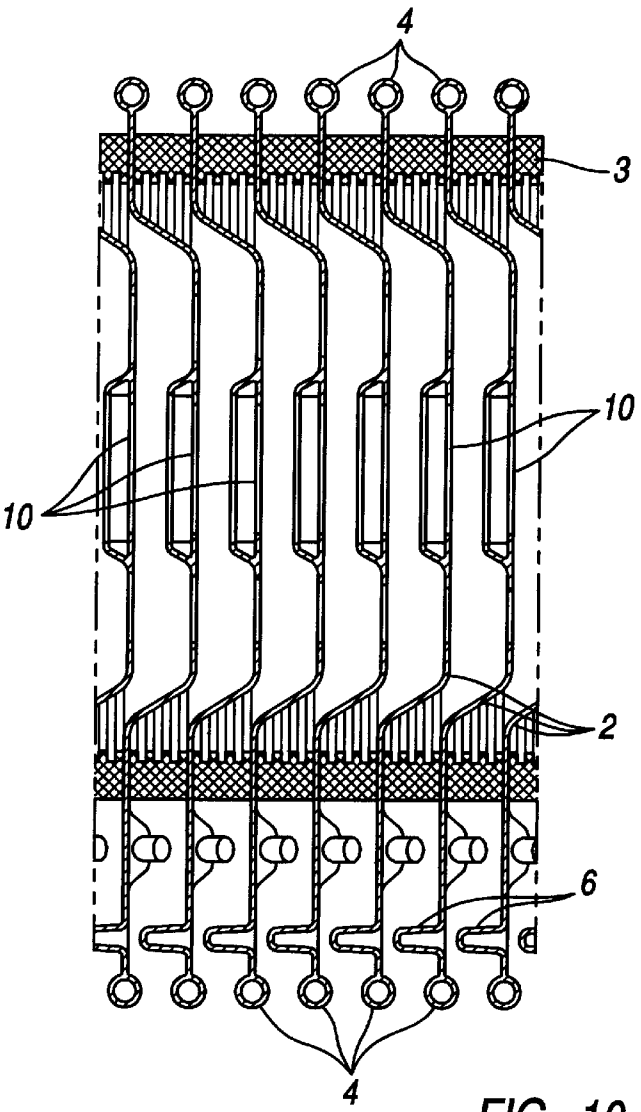

FIG. 10 shows a similar dish-shaped embodiment of the part made in the form of a plate element, which includes a corona ring 4, an electrode 2, a spark gap 6 and also a radiation-reducing magnet section 10.

Figure 11:
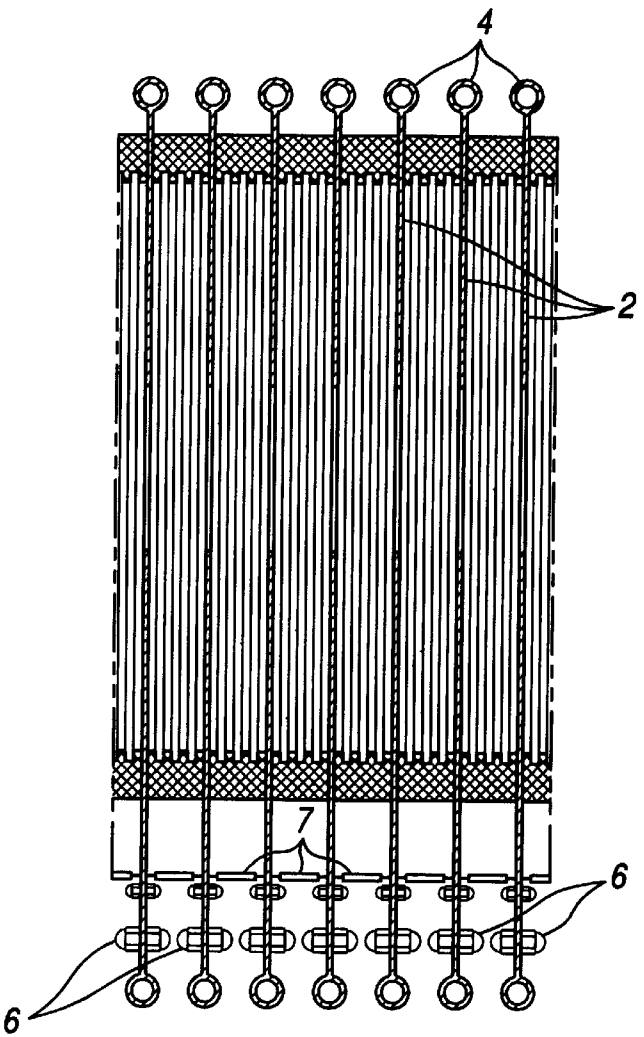
FIGS. 10–11 are cross-sectional views of further embodiments of a part of the accelerating tube according to the invention, which part comprises elements.

FIG. 11 shows an embodiment where the element having a corona ring 4, an electrode 2, a spark gap 6 is flat. Radiation-reducing magnet sections 10 may be used, if desired.

The spark gaps in the various embodiments described above may be formed by blanking, dishing, deep-drawing or bending operations. In those cases where the various parts of an element must be interconnected prior to assembly, the connecting may take place by welding, soldering, pressing, screwing or for example gluing, if desired.

What is claimed is:

1. A particle accelerator comprising:

at least one accelerating tube, said tube including a plurality of spatially separated electrodes and a plurality of corona rings, each corona ring substantially surrounding a respective electrode, said accelerating tube being built up of elements where each element comprises a connected electrode and corona ring; and wherein said electrode comprises at least one spark gap having a connection for connecting one side of a resistor.

2. A particle accelerator according to claim 1, wherein said connection for the resistor is a clamped connection.

3. A particle accelerator according to claim 1, wherein said connection for the resistor is a clip-on connection.

* * * * *